US009352354B2

(12) United States Patent
Summons et al.

(10) Patent No.: US 9,352,354 B2
(45) **Date of Patent: *May 31, 2016**

(54) SYSTEM AND METHOD OF PROVIDING INDIVIDUAL QUANTITIES OF CUSTOM COLORED SEALING COMPOUND

(75) Inventors: Wayne L. Summons, Thornton, CO (US); Elliot P. Summons, Centennial, CO (US); Heather E. Burik, Thornton, CO (US)

(73) Assignee: SASHCO, INC., Brighton, CO (US)

( * ) Notice: Subject to any disclaimer, the term of this patent is extended or adjusted under 35 U.S.C. 154(b) by 591 days.

This patent is subject to a terminal disclaimer.

(21) Appl. No.: 12/053,865

(22) Filed: Mar. 24, 2008

(65) Prior Publication Data

US 2009/0236365 A1 Sep. 24, 2009

(51) Int. Cl.

| | |
|---|---|
| ***B67D 5/56*** | (2006.01) |
| ***B05C 17/005*** | (2006.01) |
| ***B05C 17/00*** | (2006.01) |

(52) U.S. Cl.

CPC ..... *B05C 17/00553* (2013.01); *B05C 17/003* (2013.01); *B05C 17/00556* (2013.01); *B05C 17/00563* (2013.01); *B05C 17/00583* (2013.01); *B05C 17/00513* (2013.01)

(58) Field of Classification Search

USPC ..... 222/129, 142.1, 145.1, 543, 327, 1, 222/568; 215/6; 220/23.83

See application file for complete search history.

(56) References Cited

U.S. PATENT DOCUMENTS

| | | | | |
|---|---|---|---|---|
| 4,284,213 | A * | 8/1981 | Lee | 222/541.2 |
| 5,114,240 | A * | 5/1992 | Kindt-Larsen et al. | 366/129 |
| 5,129,520 | A | 7/1992 | Gaspar | |
| 5,303,869 | A * | 4/1994 | Hudson, Jr. | 239/391 |
| 5,621,062 | A * | 4/1997 | Castellucci et al. | 528/30 |
| 5,735,320 | A * | 4/1998 | Tune et al. | 141/330 |
| 5,880,244 | A * | 3/1999 | Dowlen et al. | 528/15 |
| 5,909,753 | A | 6/1999 | Rossi et al. | |
| 6,020,407 | A * | 2/2000 | Campbell et al. | 524/156 |
| 6,269,979 | B1 | 8/2001 | Dumont | |
| 6,372,270 | B1 * | 4/2002 | Denny | 426/77 |
| 6,390,662 | B1 * | 5/2002 | Henry et al. | 366/177.1 |
| 7,798,363 | B2 * | 9/2010 | Brandon | 222/1 |

(Continued)

FOREIGN PATENT DOCUMENTS

| | | |
|---|---|---|
| EP | 01551645 | 7/2005 |
| KR | 1020010088828 | 9/2001 |
| WO | 2006/090180 | 8/2006 |

OTHER PUBLICATIONS

Supplementary European Search Report dated Aug. 31, 2011 for application No. EP 09725554, 3 pp.

*Primary Examiner* — Donnell Long
(74) *Attorney, Agent, or Firm* — Perkins Coie LLP

(57) ABSTRACT

A system and method for providing custom colored sealant are generally provided with a dispensing container, containing a quantity of sealant base solution. A nozzle, is shaped and sized to be removably secured with an open end portion of the dispensing container. A supplemental container is provided that contains a quantity of sealant thickener. A quantity of at least one coloring agent is added to the dispensing container and mixed with the sealant base solution, by agitating the dispensing container, until a desired color is attained. The sealant thickener is then added and the dispensing container is then agitated again. The nozzle is then coupled with the dispensing container and the custom-colored sealant is ready to be dispensed.

20 Claims, 12 Drawing Sheets

(56) References Cited

U.S. PATENT DOCUMENTS

| | | | | |
|---|---|---|---|---|
| 7,976,234 | B2 * | 7/2011 | May | 401/132 |
| 8,403,178 | B2 * | 3/2013 | May et al. | 222/129 |
| 2002/0046541 | A1 * | 4/2002 | Grunst | 52/741.4 |
| 2002/0065353 | A1 * | 5/2002 | Anderson et al. | 524/492 |
| 2006/0151531 | A1 * | 7/2006 | Tikusis | 222/145.6 |
| 2007/0086198 | A1 * | 4/2007 | Wilson et al. | 362/382 |
| 2007/0249779 | A1 * | 10/2007 | Dellandrea et al. | 524/502 |

* cited by examiner

SYSTEM AND METHOD OF PROVIDING INDIVIDUAL QUANTITIES OF CUSTOM COLORED SEALING COMPOUND

BACKGROUND

The construction and home improvement arts frequently need custom colored sealants for the improved aesthetic appearance of a wide array of projects. Common substrates where precisely color-matched caulks are needed and desired include: painted surfaces, stained surfaces, counter tops, wall paper, pre-colored siding materials, brick, stone, tile, bath and kitchen fixtures, flooring, etc. While some factory-tinted, non-custom colored caulks are available in the trade (with white being the overwhelmingly dominant color), most such colors of caulk do not match the substrates they are applied to very well.

At least one company has provided custom color-matching of individual containers of caulk. However, the custom color-matching has only been done by the company itself and only at its factory. Accordingly, such a custom-coloring service only works when: 1) the consumer or contractor is willing or able to wait several days or weeks for color submittals and then delivery from the factory; 2) the consumer is willing to purchase a relatively large volume of custom-colored caulk; and 3) the consumer is willing to pay a very high price for such factory-made custom colors of caulk.

Consumers and contractors have not been able to conveniently custom tint individual containers of sealant themselves, at a project site. In particular, the long-standing and unmet need in the market has centered around the ability to: custom tint only one or two cartridges or squeeze tubes of sealant at a time; acquire custom tinted sealant at a low-to-moderate cost; custom tint sealant without the need for special or expensive mixing or dispensing equipment; and custom tint sealant without waiting for extended periods of time. To date, these aggregate criteria have been heretofore unavailable.

Some of the key difficulties that have prevented the resolution of such problems in the prior art have centered on several issues. For example, the high viscosity of typical sealant products has made it very difficult or impossible to easily and uniformly mix liquid or dry colorants throughout the sealant. In contrast with this problem, adding and mixing liquid or dry colorants into products with lower viscosities, such as latex paint, has been relatively easy. The basic elongated geometry of standard sealant containers, which produces a high aspect-ratio container, presents another difficulty to overcome. Colorants that are introduced into one end of such elongated containers are difficult to uniformly distribute throughout the entire length of the containers.

Attempts to overcome the shortcomings of the prior art, have included the use of supplemental mechanical mixing equipment or specialized static mixers to provide the necessary mixing action and/or energy. Such equipment has included: mechanical mixing bowls; commercial mechanical paint shakers; special holding adapters for mechanical paint shakers; bladed mixing devices that are rammed back-and-forth within sealant containers; static mixers that lead to high pressure drops during dispensing (making colorant dispensing difficult, unless special, expensive, hard-to-find, high mechanical leverage caulking guns are used), etc.

Several approaches have either been proposed or commercially attempted previously to allegedly allow for an easy, fast, convenient, and inexpensive method for the custom-coloring of individual containers of caulk at or near the location in the field where the caulk is to be used. While some of the approaches taken have delivered a low level of partial success at in-the-field custom coloring of caulk in individual rigid caulk cartridges, none have provided the needed case of mixing and dispensing, economy, freedom from needing special mechanical mixing equipment, and speed of mixing that the market desires and needs. Moreover, none of the prior attempts have made it possible to custom tint individual flexible squeeze tubes of caulk in the field; leaving a great unmet need in the art.

U.S. Patent Application Publication No. 2003/0099153 to Renfro describes a system that requires the consumer or contractor to remove the slidable plunger from the rearward end of a rigid caulk cartridge in order to first place liquid pigments or a paint into the rear of the container and then insert an expensive, special bladed mixing device into the container. The bladed mixer must then be rammed back and forth inside the cartridge to mix the contents. Such an approach requires the use of the specialized bladed mixing device that might only be used once. In addition, it is impossible to use such a device without depositing a significant amount of messy caulk on the mixer's blades and shaft, which then must be cleaned, with lost caulk and lost time being the result. Moreover, it is difficult and tedious with such a device to obtain a uniform color throughout the entire length of the caulk cartridge since the user is forced to attempt to mix a liquid pigment or paint directly into a very thick and pasty latex caulk. In addition, the repeated cycling of the bladed mixer through the thick caulk causes the formation of a significant number air bubbles in the caulk. Unfortunately, there is no proposed method for removing the entrained air from the caulk. Such entrained air significantly increases the occurrence of spattered caulk and gaps in the applied caulk bead as the user dispenses the caulk. Moreover and very importantly, this approach is completely unsuited for custom-coloring caulk in flexible squeeze tubes since this approach requires that the cartridge body side walls be rigid and that the user have full access to the full diameter of the container, which is not possible with a heat-sealed squeeze tube. U.S. Patent Application Publication Nos. 2004/0173640 and 2007/0242558 to Brandon describe systems very similar to that of Renfro, with all of the same limitations and difficulties.

In another example, U.S. Patent Application Publication No. 2006/0151531 to Tikusis describes a system that uses a special rigid caulk cartridge that has two separate chambers within the overall package, with one chamber coming pre-loaded from the factory with pre-thickened base caulk material and the other chamber provided empty so that the custom coloring agent (paint, stain or liquid pigment) can be injected into this chamber by the user just before application of the caulk. While the method described, which uses a syringe to inject the coloring agent into the empty chamber, appears to be practical, in practice it can be very messy. While mixing is not done inside the special two-chambered cartridge itself, the mixing that occurs in the affixed static mixer nozzle, as both chambers are simultaneously emptied during the dispense cycle, creates back pressure that makes dispensing very difficult, especially when a person uses a common caulking gun that nearly always provides very poor mechanical leverage, as opposed to uncommon, expensive, specialized guns with high mechanical leverage. In addition, because of the highly specialized packaging and metering equipment required, the cost of the system is very high and makes it unaffordable to many who might otherwise use it. Moreover, this approach also does not and cannot allow for the use of flexible squeeze tubes, thus, greatly limiting its usefulness.

In a further example, U.S. Pat. No. 6,302,575 and U.S. Patent Application Publication Nos. 2002/0036952 and 2002/

0065353, all to Anderson et al., describe a system wherein a somewhat lower than normal viscosity caulk-forming composition is thickened by contact with a pigmented composition while the combined materials are shaken on a commercial mechanical paint shaker, reportedly yielding a custom colored, thickened caulk product. A somewhat similar approach was described within U.S. Pat. No. 4,090,612 to Lostutter, except that the base caulk material is provided initially at the typical high viscosity of common caulks. The Anderson approach involves the caulk-forming composition becoming thickened upon contact with the pigmented composition, as intense, high-energy shaking occurs on a commercial mechanical paint shaker. If a caulk-forming composition begins to thicken when contacted by a pigmented composition, it is easy to see that it would typically require the power delivered by a high-energy, commercial mechanical paint shaker to accomplish complete and uniform mixing of the pigment throughout the caulk-forming composition to get a uniform final color, especially when it is understood that by adding pigment at one end of a long, narrow, high aspect-ratio, rigid caulk cartridge it becomes quite difficult to easily and uniformly get the pigment to traverse the entire length of the cartridge in a homogeneous fashion. The Anderson, et al, approach stipulates the viscosity of the un-tinted caulk-forming composition to be in the range of 600,000 to 800,000 centipoise, which is too high to allow easy hand mixing to homogeneity of liquid or dry colorants in a caulk base. Neither of these approaches makes it feasible for a consumer or contractor to readily and quickly custom color individual rigid caulk cartridges at a job site or in their own home without the proposed expensive and cumbersome mechanical shaking devices. Moreover, neither the Anderson nor Lostutter approach makes it possible to use flexible squeeze tubes.

Accordingly, it can be seen that there exists a need for a very simple, convenient, and economical system for custom coloring individual rigid cartridges and individual flexible squeeze tubes of caulk that does not require expensive mechanical mixing equipment, specialized, high mechanical-leverage caulking guns, and also allows for the very easy dispensing of the caulk itself, with or without caulking guns, once the custom color has been achieved.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

A system and method are presented for custom coloring sealants, such as caulk. In one aspect, the system includes a dispensing container, having an open end portion that is in open fluid communication with an open interior compartment. A quantity of sealant base solution is disposed within the interior compartment of the dispensing container. A nozzle, having an open interior portion and opposite first and second end portions is provided such that the first end portion may be secured with the open end portion of the dispensing container to permit dispensing of the sealant. A supplemental container may be provided that is at least partially filled with a quantity of sealant thickener. A quantity of at least one coloring agent is also made available.

In use, the dispensing container is opened and at least a portion of the coloring agent is added to the sealant base. The dispensing container is then shaken until a desired, uniform color is attained. The sealant thickener is then dispensed from the supplemental container into the dispensing container and the dispensing container is again shaken to thoroughly mix the contents. The nozzle may then be engaged with the open end portion of the dispensing container. In one aspect a portion of the nozzle is removed, by cutting the tip off. The custom colored caulk may then be dispensed at a point of use.

In its various embodiments, the present system and method provide an easy means of allowing a consumer or contractor to homogeneously custom color individual containers of sealant at the job site. Rigid, standard caulk cartridges and flexible squeeze tubes may be used, interchangeably, without the need for additional mixing equipment. The system and method further allow the custom colored caulk to be very easily dispensed from the dispensing container after the user manually mixes the components with a simple shaking motion of the dispensing container. The amount of time required for accomplishing the needed color mixing is greatly reduced from other methods, with virtually no mess or loss of product. Moreover, the present system and method allow the user to gain easy, non-messy access to the inside of the dispensing container so as to easily introduce the required volume of coloring agent.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
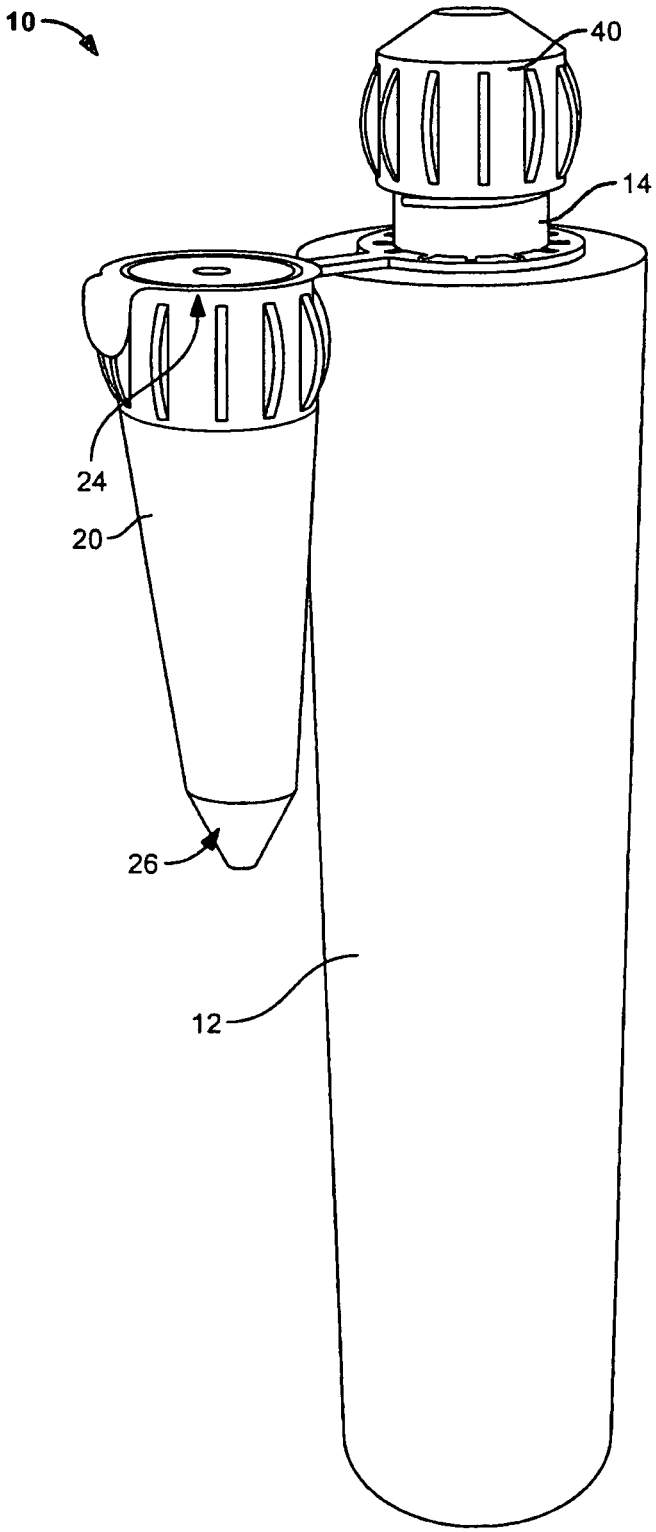
FIG. 1 depicts a front elevation view of one embodiment of the system for custom coloring sealant.

With reference to FIG. 1, the system 10 for custom coloring sealant may be provided with dispensing container 12, which may take the form of a rigid cylindrical caulk cartridge, flexible squeeze tube, and the like. The dispensing container 12 will generally have a first open end portion 14 that is in open fluid communication with an open interior compartment 16. In one aspect, the interior compartment 16 of the dispensing container 12 will be at least partially filled at the factory with a very low viscosity sealant base solution 18.

Liquid latex caulk base is an example of a sealant base solution 18 that may be used with the system 10. In one aspect, the sealant base solution 18 liquid latex caulk base is formulated to a bluish or purplish shade. When the sealant cures, it presents a "water-clear" appearance (similar to a pool of clean water) with a blue to purple cast in order to enhance the "cleanness" of the ultimate color achieved by the end user by counteracting any undesirable amber or yellowish tones that can frequently occur otherwise when some sealants are formulated to cure to a "clear" appearance. In at least one embodiment, the viscosity of the sealant base solution is in the range of 100 to 50,000 centipoise at low shear rates. Such levels of viscosity assist in making hand-mixing readily doable of the sealant base solution 18 with liquid or dry colorant that is added to the dispensing container. In one aspect, the aforedescribed viscosity range is at least an order of magnitude lower than a common viscosity range of caulk bases used in the art.

The system 10 is further provided with a nozzle 20, having an open interior portion 22 that is bordered by an open first end portion 24 and an opposite second end portion 26. In at least one aspect, the first end portion 24 is shaped and sized to be secured with the open end portion 14 of the dispensing container 12, so that the interior compartment 16 of the dispensing container 12 may be placed in open fluid communication with the interior portion 22 of the nozzle 20. In at least one embodiment, the first open end portion 14 of the dispensing container 12 is provided with a hollow, threaded nub 28. In this manner, the open first end portion 24 of the nozzle 20 may be provided with mating threads that are shaped to operatively engage the threaded nub 28. In one aspect, the diameter of the threaded nub 28 may be provided to be at least ⅝", which provides approximately 56.3% more flow area than standard ½" diameter ports found on common caulk cartridges. Moreover, an enlarged diameter provides greater ease of access for materials that are to be added to the dispensing container 12. It is contemplated, however that a wide array of different diameters may be used to form the threaded nub 28.

Figure 2:
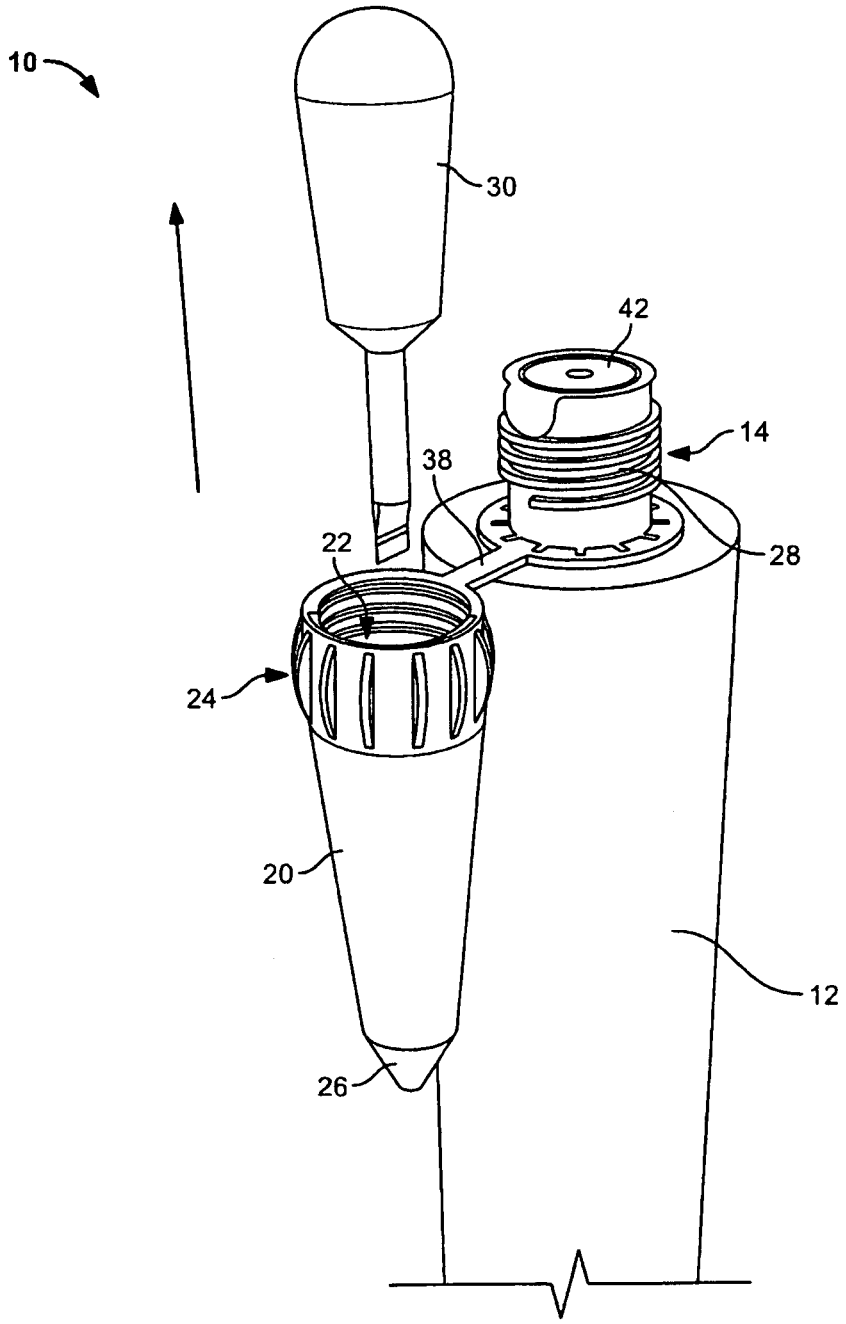
FIG. 2 depicts an isometric view of one embodiment of a nozzle and supplemental container that may be used with the system for custom coloring sealant and demonstrates one manner in which the supplemental container may be removed from a storage position within the nozzle.
Figure 10:
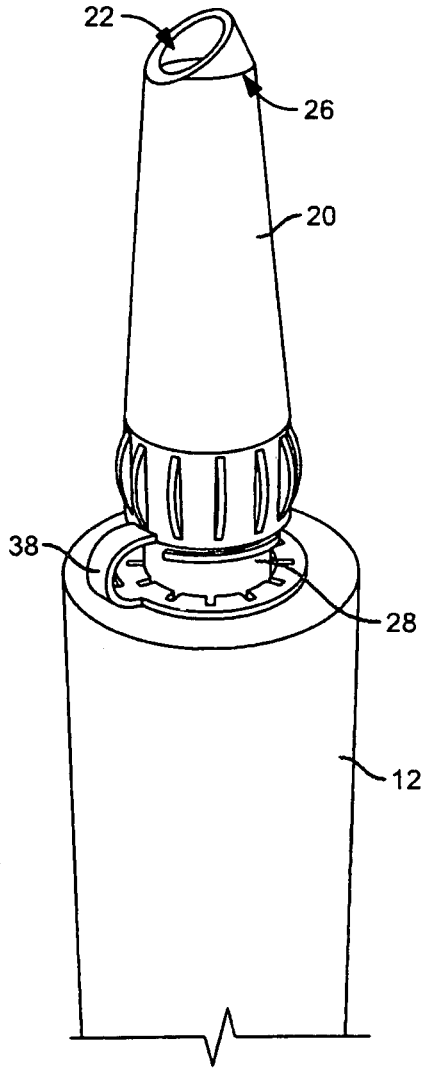
FIG. 10 is an isometric view of one embodiment of a nozzle and dispensing container that may be used with the system for custom coloring sealant and demonstrates one manner in which the nozzle may be opened to permit dispensing of the contents of the system.
Figure 11:
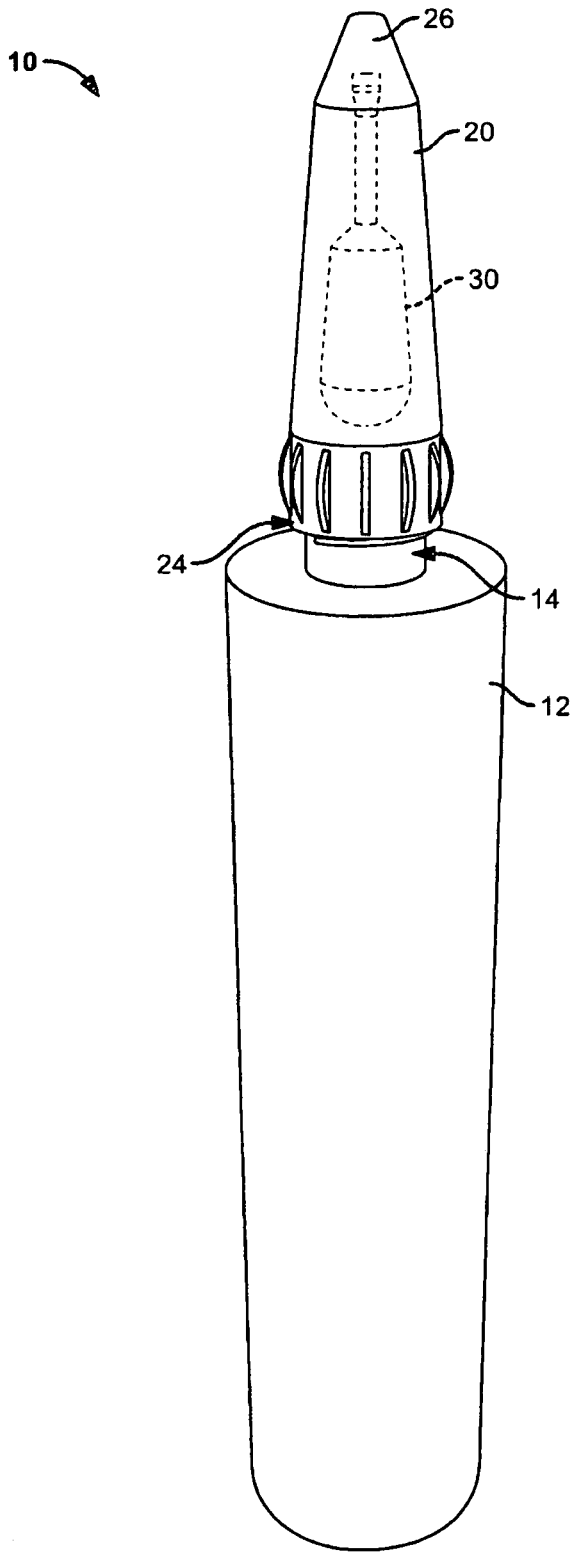
FIG. 11 depicts a front elevation view of one embodiment of the system for custom coloring sealant and demonstrates one manner in which the same may be assembled prior to its use.

With reference to FIGS. 2, 10 and 11, a supplemental container 30 may be provided, having an interior portion 32 that is at least partially filled with a quantity of sealant thickener 34. It is contemplated that the shape and size of the supplemental container may vary according to the circumstances and intended uses. However, in at least one embodiment, the supplemental container 30 is shaped and sized to fit within the interior portion 22 of the nozzle, having a lower bulb portion and an upper stem that may have a portion removed to gain access to the interior portion. Alternatively, the nozzle 20 may be filled with the liquid or dry sealant thickener 34, with the open first end portion 24 of the nozzle 20 sealed with, for example, a seal such as a foil laminated seal that is heat sealed to the open first end portion of the nozzle 20.

Figure 4:
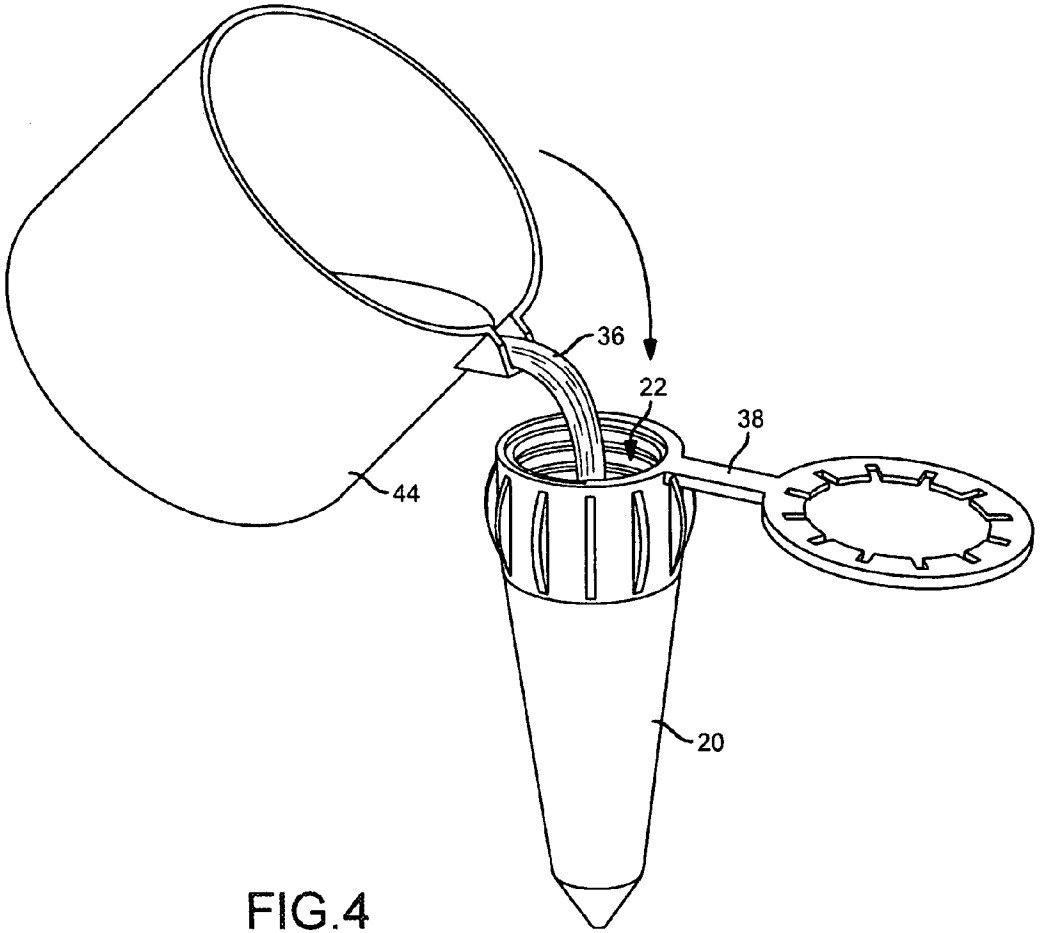
FIG. 4 is an isometric view of one embodiment of a nozzle that may be used with the system for custom coloring sealant and demonstrates one manner in which the nozzle may be used as a measuring device.
Figure 5:
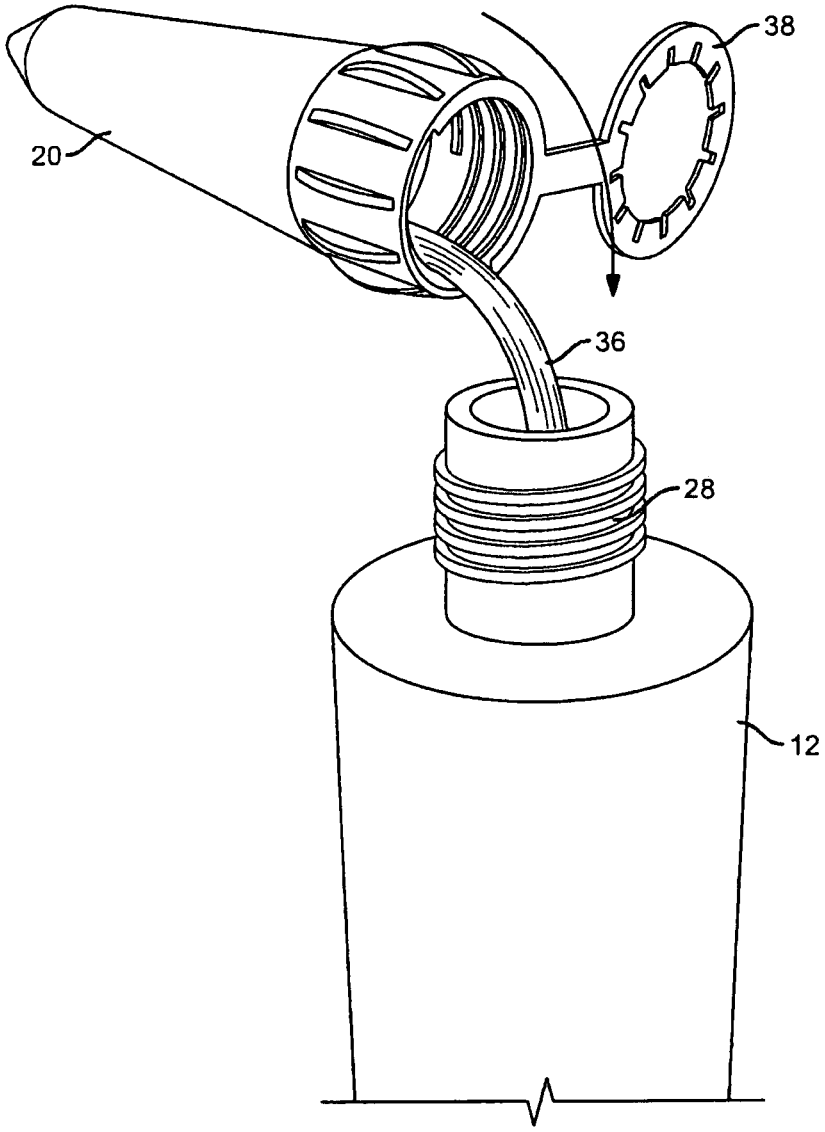
FIG. 5 is an isometric view of one embodiment of a nozzle and dispensing container that may be used with the system for custom coloring sealant and demonstrates one manner in which the nozzle may be used to introduce additive materials to the interior chamber of the dispensing container.
Figure 6:
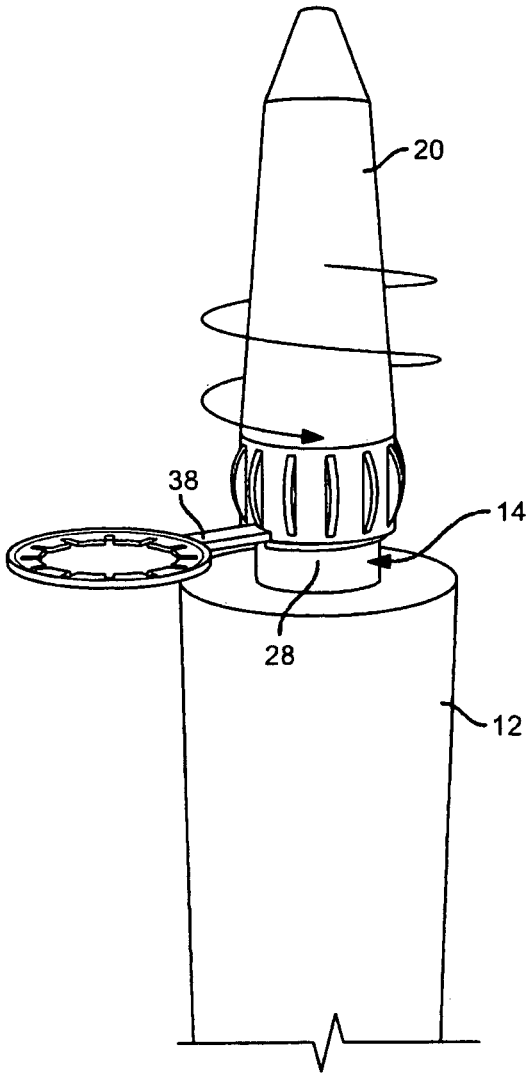
FIG. 6 is an isometric view of one embodiment of a nozzle and dispensing container that may be used with the system for custom coloring sealant and demonstrates one manner in which the nozzle may be secured with an open end portion of the dispensing container prior to agitating the contents of the dispensing container.

With reference to FIG. 4, the system 10 should be provided with a quantity of at least one coloring agent 36. In one aspect multiple coloring agents 36 may be provided. It is contemplated that the coloring agent may take many different forms. For example, the coloring agent 36 may be comprised of liquid pigments, dry pigments, latex paint or latex stain. The coloring agent may be provided in a secondary supplemental container similar to that described for the supplemental container 30. However, it is also contemplated that the coloring agent will be provided by the end user in order to obtain a close color match to the substrate on which the sealant is to be used.

Figure 3:
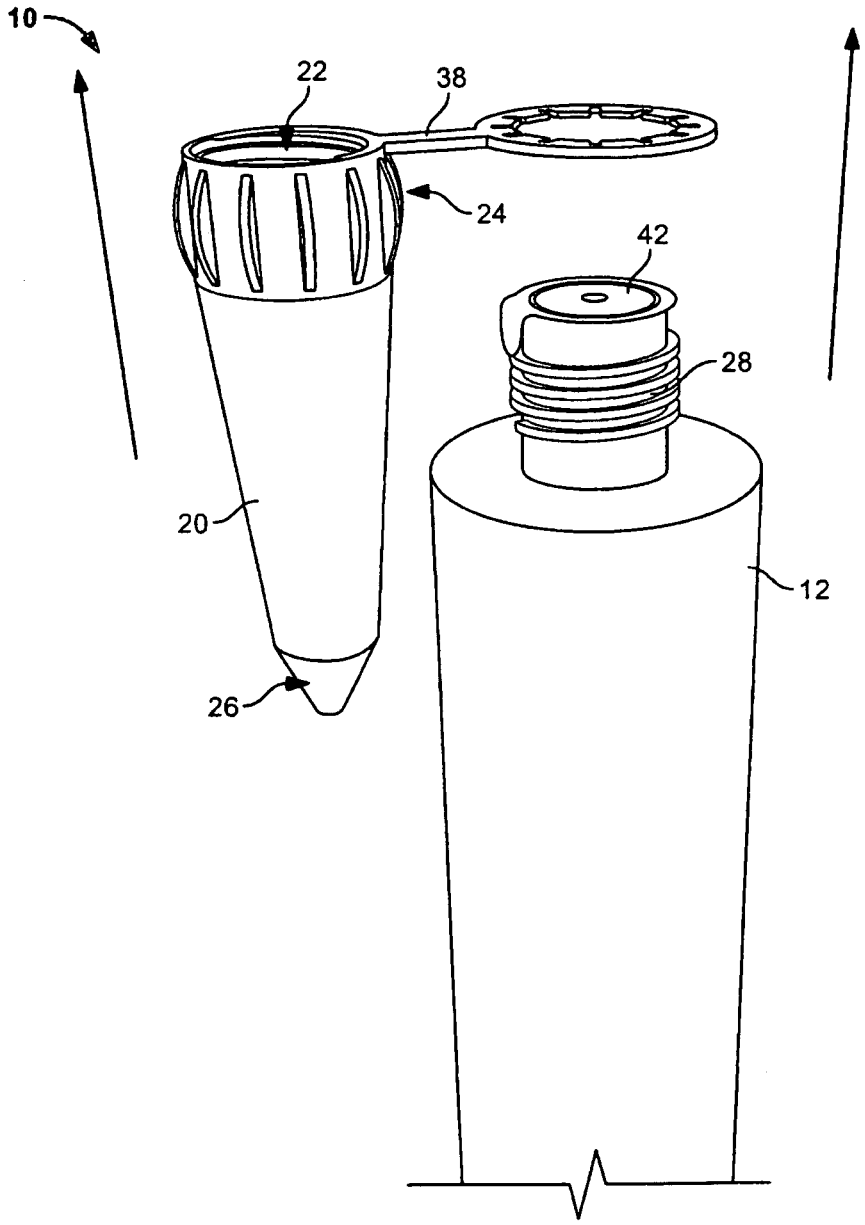
FIG. 3 depicts an isometric view of one embodiment of a nozzle and dispensing container that may be used with the system for custom coloring sealant and demonstrates one manner in which the nozzle may be removed from the dispensing container.

With reference to FIGS. 2 and 3, the nozzle 20 may be coupled with the dispensing container 12. In one embodiment, the nozzle 20 is coupled with the threaded nub 28 of the dispensing container 12 using a generally flexible strap 38 having opposite first and second end portions. In one aspect, the first end portion of the strap 38 may be provided to encircle the threaded nub 28 to keep the nozzle 20 and dispensing container 12 together during transport and storage, prior to being used. Fingers within the first end portion of the strap 38 may releasably engage the threads (or other structural feature) of the nub 28. The second end portion may be integrally or mechanically coupled with the nozzle 20 in one of various known methods.

A cap 40 may be removably coupled with the first open end portion 14 of the dispensing container 12 in a manner similar to that described herein with respect to the open first end portion 24 of the nozzle 20. The cap will provide a measure of containment and protection to the contents of the dispensing container during transport, agitation, and storage of the system 10. As such the cap 40 may be used between uses of the system 10 after the sealant has been custom colored. Similarly, the system 10 may be provided with one or more removable seals 42 that may be secured across the first open end portion 14 of the dispensing container 12 and the open first end portion 24 of the nozzle 20. Such seals may be secured with the system 10 prior to initial transport and storage of the system 10 in order to contain and protect to the contents of the dispensing container 12 and the nozzle 20 when a supplemental container 30 or other article is stored within the nozzle 20, respectively. It is contemplated that various paper, plastic and foil materials may be used when forming the seals 42. However, such materials may vary according to the circumstances and intended use of the system 10.

Figure 12:
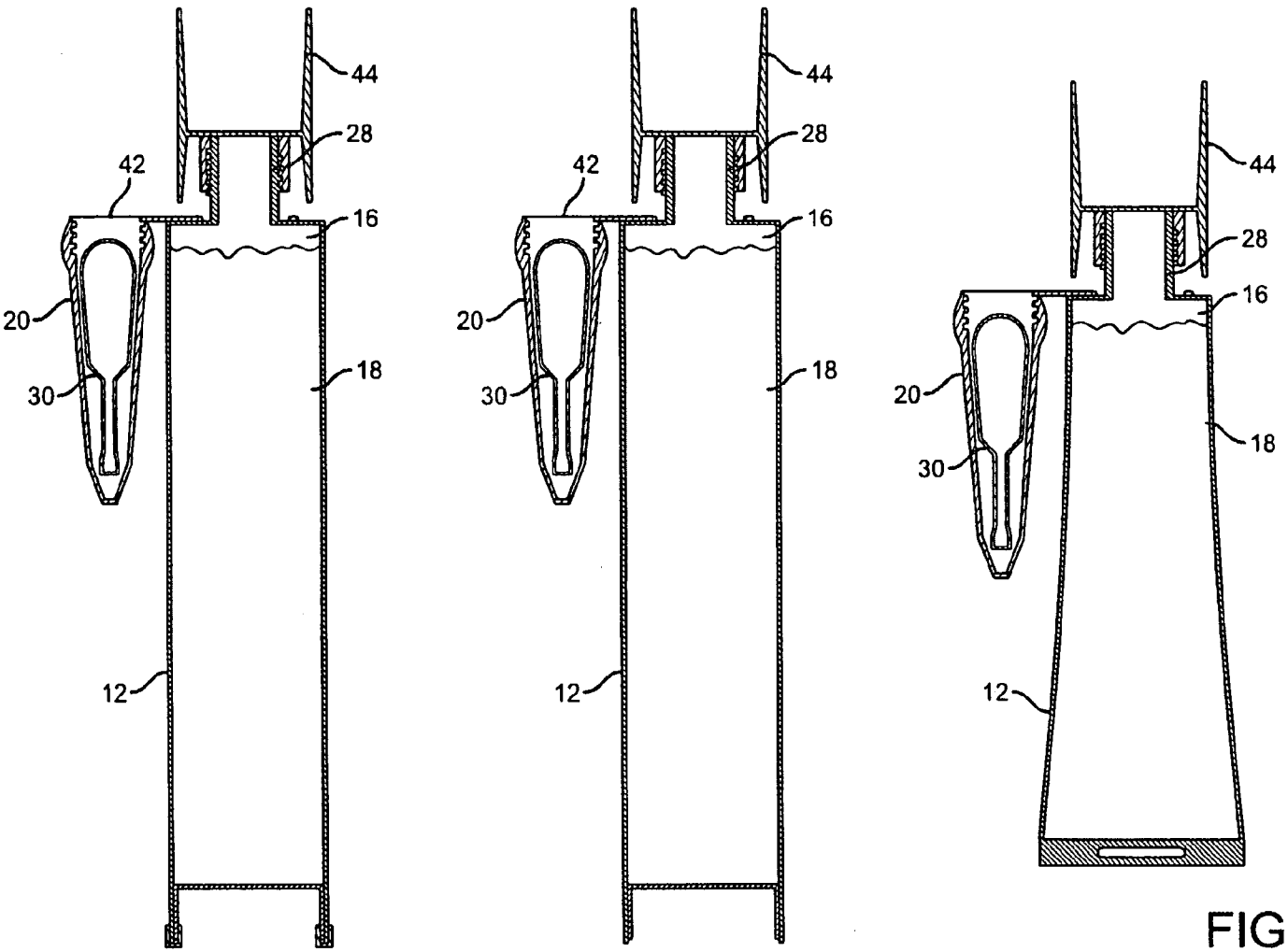
FIG. 12 depicts a front cross-sectional/elevation view of three embodiments of the system for custom coloring sealant and demonstrates various manners in which the same may be assembled prior to its use.

In at least one embodiment, such as depicted in FIG. 12, the system may be provided with a measuring cup 44 that is coupled with the open first end portion 14 of the dispensing container 12. The dispensing cup will be beneficial for metering quantities of sealant thickeners, coloring agents, or other additives. Alternatively, the nozzle 20 and/or cap 40 may be used as measuring devices obviating the need for a devoted measuring cup.

With further reference to FIG. 12, the dispensing container 12 may be fitted with a small annular clamping ring 46 that wraps at least partially around and clamps down on both the end of the cartridge wall and the end of the skirt of a plunger 48 that moves linearly within the dispensing container 12. The clamping ring may be formed from metal, plastic or other suitable materials. When the clamping ring 46 is coupled with the end of the dispensing container 12, the plunger 48 is prevented from being forced out of the back end of a dispensing container 12 while a user shakes or otherwise agitates the dispensing container during the colorant mixing or thickening procedures. While it is contemplated that the system 10 may be provided with a dispensing container 12 without such a clamping ring 46, a potential exists for the plunger 48 exiting the back end of the dispensing container 12 while it is agitated by the user. If the plunger 48 inadvertently exits the back of the dispensing container 12, the contents would be ejected, creating a mess.

In another aspect, the dispensing container 12 may be provided with a sidewall that is at least partially transparent. In one embodiment a substantial portion of the sidewall may be transparent, while in another embodiment, a generally transparent window 50 may be formed in the sidewall; leaving the remainder of the sidewall relatively opaque. In this aspect the user is provided with a convenient means for viewing the contents of the dispensing container 12. This may be particularly useful when the user needs to determine the final color of the contents after the colorant mixing procedure without opening the dispensing container 12. It may further provide the benefit of allowing the user to visually determine the level of viscosity attained after the thickening procedure.

Examples of sealant thickeners suitable for producing non-sag caulk viscosity, when such agents are introduced into the sealant base solution 18 described above, include, but are not in any way limited to: ammonium hydroxide, sodium hydroxide, potassium hydroxide, 2-amino methyl propanol, Acrysol ASE-60, Acrysol SCT-275, Acrysol RM-2020, Acrysol RM-825, Carbopol Aqua SF-1, Polyphobe 106HE, Tafigel PUR-61, Methocel, Bermocoll, Tylose, Rheolate 1, Rheolate 425, etc.

In at least one embodiment, a representative formula for a generalized low-viscosity sealant base solution described above (with many possible variations from this example also being possible), is as follows:

| | | |
|---|---|---|
| Rhoplex 2620 | 84.16% | Acrylic latex emulsion |
| T-Det N-407 | 0.18% | Surfactant |
| Water | 3.35% | Solvent |
| Mergal 395 | 0.14% | Biocide |
| Ethylene Glycol | 0.92% | Anti-freeze agent |

-continued

| | | |
|---|---|---|
| 100LV Light Base Oil | 8.21% | Plasticizer |
| Ammonium Hydroxide 26BE | 0.25% | pH adjuster |
| Polyphase 678 | 0.10% | Biocide |
| Silquest A-1106 | 0.18% | Adhesion promoter |
| Zinplex 15 | 2.48% | Cross-linking agent |
| Violet dye/IPA solution | 0.05% | Yellow-neutralizing dying agent |
| Total > | 100.0% | |

Physical properties of the above sealant base solution include:

| | |
|---|---|
| Density > | 8.66 lbs/gallon |
| pH > | 7.11 |
| Viscosity > | 7,000 centipoise (Brookfield, #63 spindle @ 3 rpm) |
| Percent solids > | 59.57% |
| VOC content > | 26.69 grams/liter |

It must be understood, however, that the examples of thickening agents and sealant base solutions disclosed above are merely representative of a virtually infinite number of variations in raw materials and formula-proportions that could yield a similar final result for one skilled in the art of formulating sealants. For example, while the above sealant base solution is founded on the use of an acrylic latex emulsion polymer (Rhoplex 2620), the following polymer emulsion types could, without limitation, also be used to a similar effect: styrene-acrylic polymers, ethylene-vinyl acetate polymers, styrene-butadiene polymers, urethane polymers, acrylic-urethane polymers, vinyl acetate polymers, butyl polymers, and the like. Similar variations, without limitation, are equally possible for such formula-dependent raw materials as: surfactants, biocides, anti-freeze agents, plasticizers, pH control agents, adhesion promoters, cross-linking agents dying agents, texturizing agents, solvents, matting agents, etc.

Figure 7:
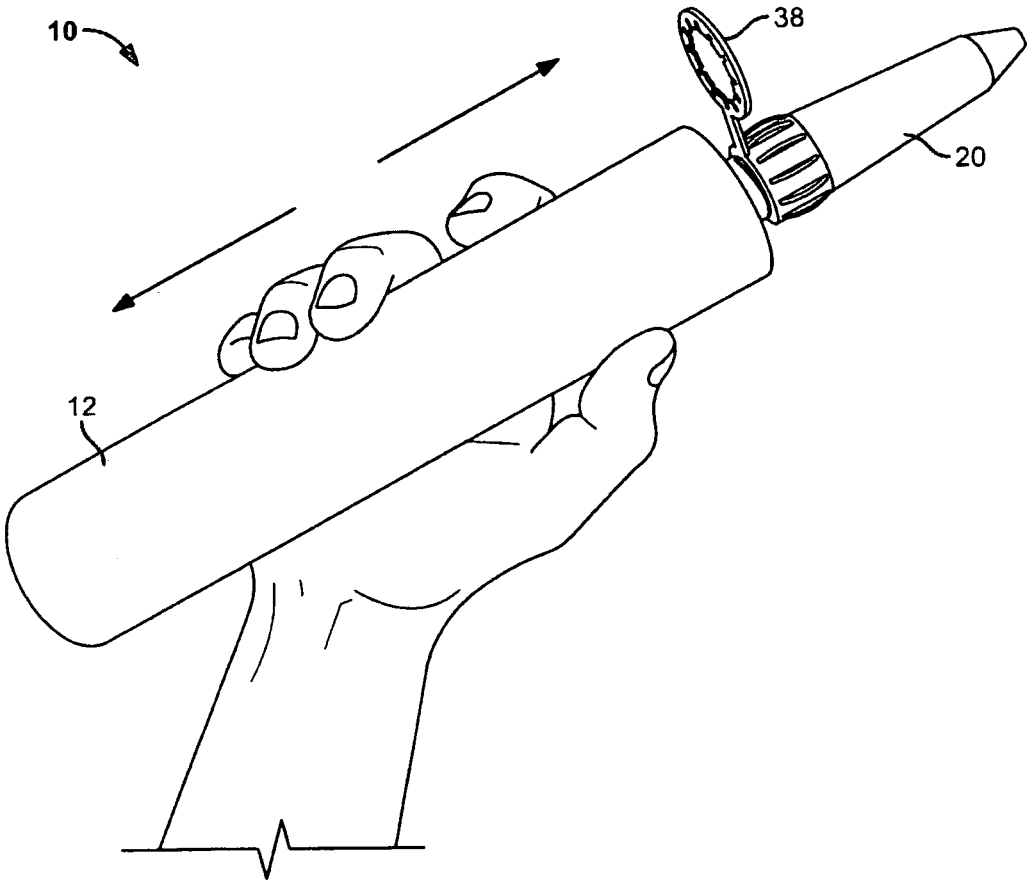
FIG. 7 depicts a perspective view of one embodiment of the system for custom coloring sealant and demonstrates one manner in which the system may be agitated to mix its contents.
Figure 8:
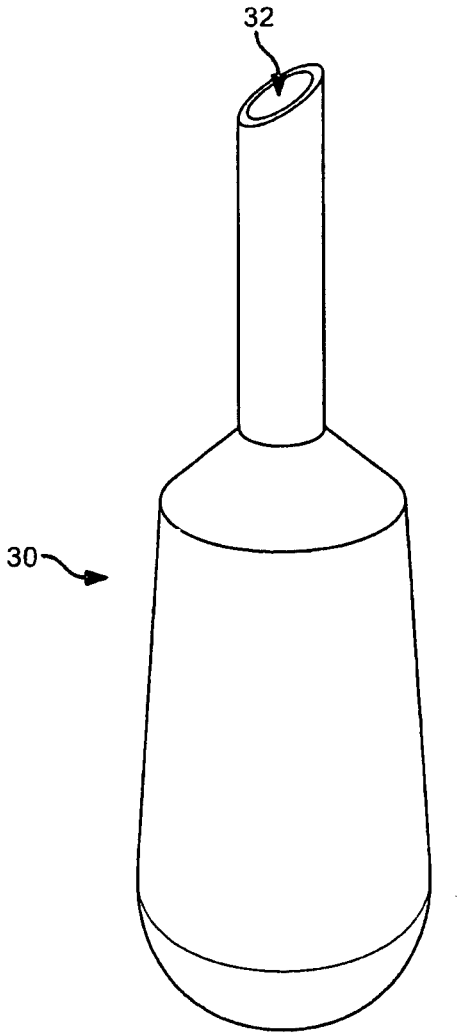
FIG. 8 depicts a front elevation view of one embodiment of a supplemental container that may be used with the system for custom coloring sealant and demonstrates one manner in which it may be opened.
Figure 9:
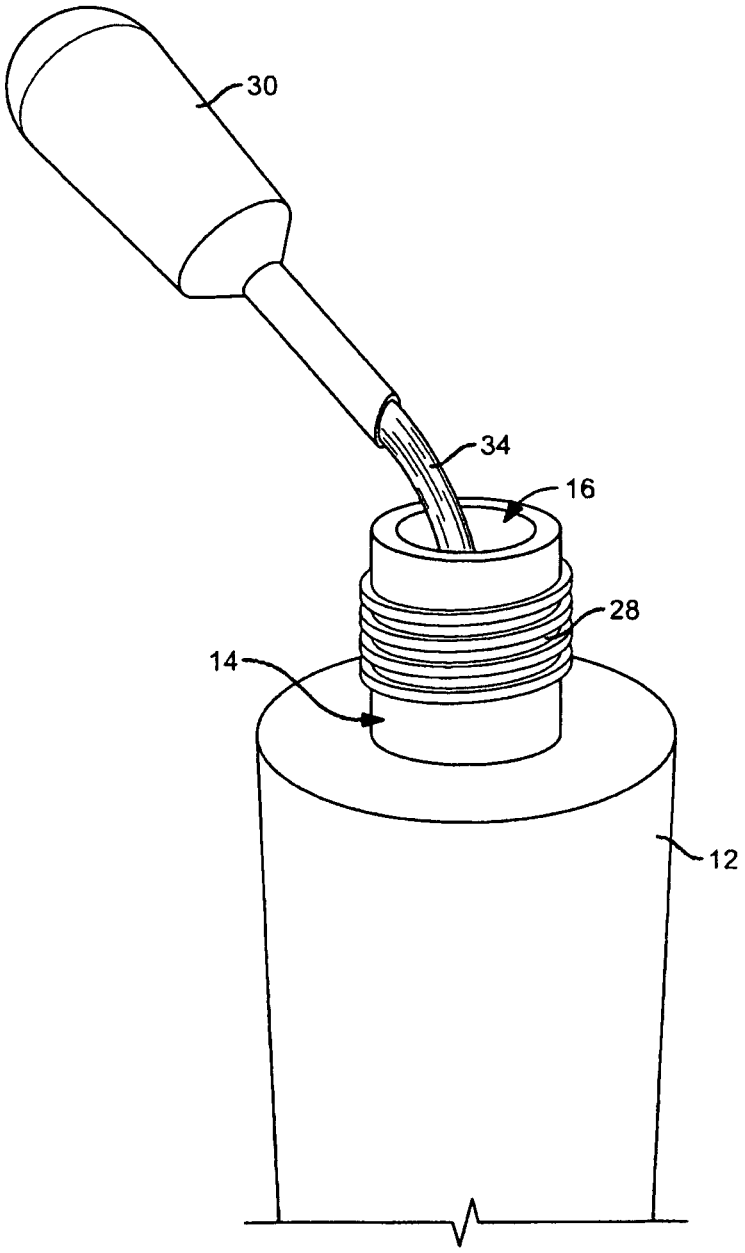
FIG. 9 is an isometric view of one embodiment of a supplemental container and dispensing container that may be used with the system for custom coloring sealant and demonstrates one manner in which the supplemental container may be used to introduce supplemental materials to the interior chamber of the dispensing container.

In one manner of use, the dispensing container 12 is opened and a quantity of at least one coloring agent 36 is introduced into the interior compartment 16 of the dispensing container 12. The user then agitates the contents of the interior compartment 16 of the dispensing container 12, such as by shaking the dispensing container 12 by hand as depicted in FIG. 7, until the contents are mixed. Additional coloring agent 36 may be added and subsequently mixed until the sealant base solution 18 approximates a final desired custom color. The user may then introduce a quantity of said sealant thickener 34 from the supplemental container 30 to the interior compartment 16 of the dispensing container 12. The dispensing container should again be agitated, such as by hand shaking the dispensing container 12, until the contents are mixed throughout the length of the dispensing container 12. This step should achieve a requisite high viscosity and strongly pseudo-plastic or thixotropic rheological flow profile that is typically needed for an easily applied and non-sagging, custom colored, sealant material. A user may then operatively couple the first end portion 24 of the nozzle 20 with the first open end portion 14 of the dispensing container 12, remove a portion of the second end portion 26 of the nozzle to create a desired size and shape of sealant bead, and dispense the sealant material as desired.

The present system and method for custom coloring individual containers of sealant provide the ability to use rigid cartridges or flexible squeeze tubes, interchangeably. Just as important, however, the present system and method provide an inexpensive, highly accurate, self-contained, convenient means of measuring the proper amount of coloring agent 36 (such as a pigmented latex paint) that is to be introduced into the dispensing container 12. Once the sealant has been custom colored and thickened it can be very easily dispensed from a rigid cartridge with a common, standard, readily available, low-mechanical-leverage caulking gun or dispensed directly from a squeeze tube by simply squeezing through a short, low-back-pressure nozzle. Accordingly, consumers and contractors are provided a self-contained, easy to use, fast, inexpensive, and convenient means of custom coloring individual containers of sealant anywhere it may be required, without the need of any additional specialized equipment, special mixing devices, or outside services. The components associated with the present system and method can be manufactured at a relatively modest cost and in a readily usable and familiar format.

Although the system has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A system for providing custom colored, non-sag caulk; the system comprising:

a caulk dispensing container, having a first open end portion that is in open fluid communication with an open interior compartment;

a quantity of liquid caulk base solution disposed within the interior compartment of said dispensing container; the liquid caulk base solution having a viscosity of 100 centipoise to 50,000 centipoise;

a nozzle, having an open interior portion and opposite first and second end portions, said first end portion being shaped and sized to be secured with the open end portion of said dispensing container so that the interior compartment of said dispensing container is placed in open fluid communication with the interior portion of said nozzle; and a supplemental container having an interior portion that is at least partially filled with a quantity of caulk base thickener that is sufficient to produce a non-sag caulk of a thixotropic rheological flow profile when mixed with the liquid caulk base solution.

2. The system of claim 1 further comprising a cap that is removably coupled with the first open end portion of said dispensing container.

3. The system of claim 1 further comprising a removable seal that is secured across the first open end portion of said dispensing container.

4. The system of claim 1 wherein said nozzle is coupled with said dispensing container by a strap that extends between said nozzle and said dispensing container.

5. The system of claim 1 wherein said first open end portion of said dispensing container is shaped as a nub that releasably and securably receives the first end portion of said nozzle.

6. The system of claim 5 wherein said nozzle is coupled with said dispensing container by a strap that extends between said nozzle and said nub.

7. The system of claim 1 wherein said supplemental container is sized and shaped to be disposed within the interior portion of said nozzle.

8. The system of claim 7 wherein said supplemental container is disposed within the interior portion of said nozzle and an opening in the first end portion of said nozzle is temporarily closed with a removable seal so that said supplemental container is not unintentionally dislodged from within the interior portion of said nozzle.

9. The system of claim 1 wherein said dispensing container is provided as a generally rigid cartridge.

10. The system of claim 1 wherein said dispensing container is provided as a generally flexible squeeze tube.

11. A method of producing a custom colored, non-sag caulk; the method comprising:

providing a caulk dispensing container, having a first open end portion that is in open fluid communication with an open interior compartment that is at least partially filled with a quantity of liquid caulk base solution; the liquid caulk base solution having a viscosity of 100 centipoise to 50,000 centipoise;

providing a nozzle, having an open interior portion and opposite first and second end portions, said first end portion being shaped and sized to be secured with the open end portion of said dispensing container so that the interior compartment of said dispensing container is placed in open fluid communication with the interior portion of said nozzle;

providing a supplemental container having an interior portion that is at least partially filled with a quantity of caulk base thickener;

introducing a quantity of at least one coloring agent into the interior compartment of said dispensing container and agitating the contents of the interior compartment of said dispensing container until the contents are mixed and the liquid caulk base solution achieves a final custom color;

introducing a quantity of said caulk base thickener from said supplemental container to the interior compartment of said dispensing container and agitating the contents of the interior compartment of said dispensing container until the contents are mixed and thickened, producing a non-sag caulk of a thixotropic rheological flow profile; and operatively coupling the first end portion of the nozzle with the first open end portion of said dispensing container.

12. The method of claim 11 wherein said supplemental container is sized and shaped to be disposed within the interior portion of said nozzle.

13. The method of claim 12 wherein said supplemental container is disposed within the interior portion of said nozzle and an opening in the first end portion of said nozzle is temporarily closed with a removable seal so that said dispensing container is not unintentionally dislodged from within the interior portion of said nozzle; said seal being removed from the first end portion of said nozzle and said supplemental container being removed from said nozzle prior to the step of introducing the sealant thickener into the interior compartment of said dispensing container.

14. The method of claim 11 further comprising:

removing a portion of the second end portion of said nozzle after the nozzle is operatively coupled with the first open end portion of said dispensing container and the contents of the interior compartment of said dispensing container have been mixed.

15. The method of claim 11, wherein at least one of the steps of agitating the contents of the interior compartment of said dispensing container is performed by shaking the dispensing container by hand.

16. A system for providing custom colored, non-sag caulk; the system comprising:

a dispensing container, having a first open end portion that is in open fluid communication with an open interior compartment;

a quantity of liquid caulk base solution disposed within the interior compartment of said dispensing container; the liquid caulk base solution having a viscosity of 100 centipoise to 50,000 centipoise;

a nozzle, having an open interior portion and opposite first and second end portions, said first end portion being shaped and sized to be secured with the open end portion of said dispensing container so that the interior compartment of said dispensing container is placed in open fluid communication with the interior portion of said nozzle; and a quantity of caulk base thickener that is sufficient to produce a non-sag caulk of a thixotropic rheological flow profile when mixed with the liquid caulk base solution.

17. The system of claim 16 wherein said quantity of caulk base thickener is disposed within the open interior portion of said nozzle and a removable seal is secured across an opening in the first end portion of said nozzle so that said quantity of sealant thickener remains within the interior portion of said nozzle until said removable seal is removed.

18. The system of claim 16 wherein at least a portion of a sidewall of said dispensing container is transparent or translucent.

19. The system of claim 16 further comprising:

a measuring cup, having an open first end portion that is in communication with an interior portion and one or more measurement indicators that define at least one predetermined volume of the interior portion; said measuring cup being removably secured with said dispensing container.

20. The system of claim 16 wherein said liquid caulk base solution is formulated so that when said liquid caulk base solution is mixed with said caulk base thickener and allowed to cure, the resulting non-sag caulk presents a "water-clear" appearance or a clear appearance with a blue to purple cast.

* * * * *